US005613762A

United States Patent [19]

Agabekov

[11] Patent Number: 5,613,762

[45] Date of Patent: Mar. 25, 1997

[54] LIGHT ASSEMBLY

[76] Inventor: Branka Agabekov, 73, route de Thonon, CH-1222 Vesenaz, Switzerland

[21] Appl. No.: 368,594

[22] Filed: Jan. 4, 1995

[51] Int. Cl.[6] ..... F21V 11/00

[52] U.S. Cl. ..... 362/240; 362/249; 362/290; 362/328; 362/346; 362/368

[58] Field of Search ..... 362/240, 249, 362/244, 245, 246, 247, 219, 222, 225, 368, 297, 354, 290, 328, 346, 343, 342

[56] References Cited

U.S. PATENT DOCUMENTS

| | | | |
|---|---|---|---|
| 2,559,641 | 7/1951 | Kruger | 362/222 |
| 3,562,510 | 6/1968 | Baldwin | 362/368 |
| 5,008,791 | 4/1991 | Caferro | 362/342 |
| 5,027,262 | 6/1991 | Freed | 362/249 |
| 5,260,859 | 11/1993 | Lettenmayer | 362/219 |

FOREIGN PATENT DOCUMENTS 1243645 10/1988 Canada .

9217868 5/1993 Germany .

*Primary Examiner*—Ira S. Lazarus
*Assistant Examiner*—Alfred Basichas
*Attorney, Agent, or Firm*—Ostrolenk, Faber, Gerb & Soffen, LLP

[57] ABSTRACT

A light assembly having a housing for retaining two conductive strips with a succession of tabs placed at predetermined distances apart so as to form pairs of electric contacts for electrically feeding a succession of bulbs arranged between two adjacent contacts. A reflector having a parabolic shape in section is arranged within the housing in the direction of its length. The focus of the reflector is arranged in the vicinity of the center of the bulbs so as to constitute a linear reflector distributing a narrow beam of light all along the light assembly. At least one diffusion screen adapted to direct and deflect the beam of light in a preferred direction is provided in the housing. Several striplights may be used for illuminating large surfaces. The striplights are placed end to end with screens provided so as to conceal the sources of light from view.

18 Claims, 2 Drawing Sheets

LIGHT ASSEMBLY

BACKGROUND OF THE INVENTION

The present invention relates to a light assembly for illuminating, for example, large areas of building fronts or ceilings, or the like, and in particular to striplights that can extend a distance.

European Patent Application EP-0.375.623 of the present applicant discloses an electric feed striplight having a series of pairs of electric contacts connected to at least two superposed conductive strips. At predetermined distances apart, the conductive strips have a plurality of tabs projecting therefrom at 90° angles for electrifying a series of bulbs, each arranged between two adjacent contacts. Each of the conductive strips is covered by a continuous insulating body arranged along the entirety of at least one of its faces. The conductive strips are disposed in a stack and except for their contact tabs, the conductive strips are completely insulated from each other and from the outside.

European Patent Application EP-0.516.578, also by the present applicant, proposes that the conductive strips be slid into a profiled member having a central clearance for the conductive strips and an opening through which the contact tabs pass.

SUMMARY OF THE INVENTION

It is an object of the invention to provide a light assembly which is suitable for illuminating large areas and provides aesthetically pleasing illumination.

Another object is to make it possible to arrange the light assembly either longitudinally or transversely, depending on the aesthetic effect that is desired.

A light assembly according to the present invention includes a housing comprising a profiled member that includes attachment means for attaching the light assembly to another structure. The housing is adapted to receive within it at least two conductive strips each having a succession of tabs located at predetermined distances apart so as to form pairs of electric contacts for electrically powering a succession of bulbs arranged along the length of the light assembly and between two adjacent contacts. A reflecting strip having a parabolic shape in cross-section is arranged in and extends continuously within the profiled member in its lengthwise direction. The reflecting strip is traversed by the tabs of the electrical contacts. The focus of the parabolic shape is in the vicinity of the center of the bulbs arrayed along the length of the reflecting strip. The parabolic reflecting strip forms a linear reflector that distributes a narrow beam of light all along the light assembly. At least one diffusion screen is disposed in the light beam and is adapted to direct the light beam and to deflect it in a preferred direction.

The invention also includes the use of several striplights in a row along the profiled member or housing to enable lighting large surfaces. Individual lights may be arrayed end to end in such a manner that the beam of light is substantially parallel to the surface so as to illuminate it uniformly.

Other features and advantages of the present invention will become apparent from the following description of the invention which refers to the accompanying drawings.

DESCRIPTION OF A PREFERRED EMBODIMENT

The light assembly of the invention has been described with reference to a striplight. However, it is not intended to limit the scope of the invention to use only with striplights.

Figure 1:
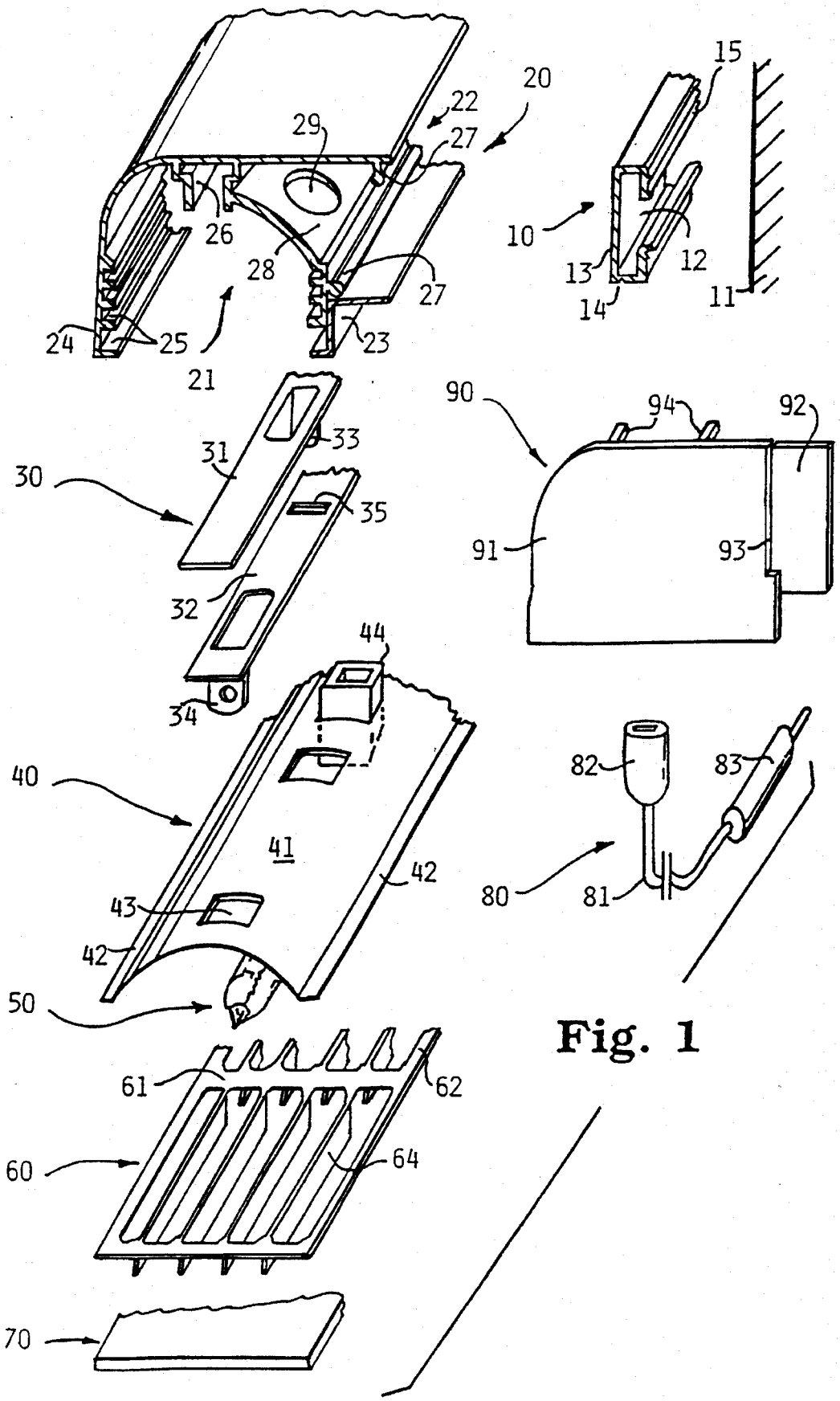
FIG. 1 is an exploded perspective view of portions of the main components of a light assembly of the invention.

FIG. 1 shows an attachment rail 10 for fastening a striplight of the invention on a wall 11. The attachment rail 10 may be fastened horizontally or vertically onto the wall 11, and can also be arranged at any other intermediate angular position for illuminating, for instance, the front of a building.

The attachment rail 10 permits a profiled member which defines a housing 20 to be attached to the attachment rail 10. The housing 20 receives elongate conductive strips 30, a reflector 40 below the strips 30, bulbs 50 supported below the reflector 40, a diffusion screen 60 beneath the bulbs 50, and a protective glass plate 70. The electric current feed has been indicated diagrammatically by a connection assembly 80. Furthermore, each of the two open ends of the assembly is covered with an end piece 90.

In the case of a wall mounted striplight, the attachment rail 10 may be fastened to the wall 11 in a known manner so that the rail 10 is positioned for optimum illumination of the wall 11. For this purpose, an inclinable support may be employed, making it possible to incline the rail 10 with respect to the surface to be illuminated. Furthermore, the rail 10 may be positioned at a certain distance from the wall, using adjustable supports that are known to persons skilled in the art.

The attachment rail 10 has a lengthwise extending opening 12 for passage of the electric conductors or wires 81. The outside face of the rail 10 has a parallelepiped covering 13. On one face, the bottom one, there is a longitudinal clearance 14. A single longitudinal clearance 14 has been shown in FIG. 1, but it is preferred that two clearances 14 be provided on opposite faces of the rail 10 so that the rail 10 can be used in one direction as well as the other. A rounded groove 15 is provided on the inner side of the rail 10.

The housing 20 is preferably formed of a profiled member having, for example, a cross section of about 15 square centimeters and which is cut into lengths of, for example, one to several meters, depending on the uses contemplated. The housing 20 essentially has two closed sides and is open, i.e. it has longitudinal recesses or openings 21 and 22, on two of its faces. The opening 21 permits the passage of the light beam while the opening 22 is provided with means for attachment of the housing 20 to the rail 10.

The recess 21 is bordered by two side flanges 23 and 24. Each flange is provided with a series of longitudinal grooves 25 and the grooves on the two flanges face each other. The flange 23 is arranged facing the surface to be illuminated while the flange 24 forms the part that protrudes furthest with respect to the wall 11. The back or interior of the recess 21 has a central rail 26.

The recess 22 is of a shape and height corresponding to that of the rail 10. Its top and bottom walls are each provided with a bead 27 intended to cooperate with the clearance 14 and the groove 15 when the housing 20 is arranged on the attachment rail 10. An intermediate wall 28 is provided, which creates a clearance path along the housing, to receive electric feed wires 81 that pass through the wall 28 via an opening 29.

The rail 10 and the housing 20 are preferably made of aluminum and may be extruded. The housing 20 is furthermore subjected to a surface treatment that imparts an insulating layer to it. This treatment is, for instance, effected by anodization or electro-deposition in order to obtain both insulation and an aesthetic effect, and the color of which may coincide with that of the wall to be illuminated.

The conductive strips 30 comprise two strips 31 and 32. At regular intervals, each strip 31, 32 has respective tabs 33 and 34 that are bent off at an angle of 90° to the surface of the corresponding strip 31, 32. Furthermore, at least one strip 32 has a clearance 35 for the passage therethrough of the tab 33 of the other strip 31. The conductive strips 31, 32 are preferably made of brass and are coated with an insulating layer, except for the end portions of the tabs 33 and 34. This insulating layer may be applied in a known manner by electrostatic dusting.

The reflector 40 is formed of a profiled strip having a central portion 41 of parabolic cross section. Two lateral flanges 42, which are intended to fit in one of the pairs of longitudinal grooves 25 of the housing 20 (FIG. 2), extend from the central portion 41. The parabolic curvature of the central portion 41 is determined as a function of the distance of the reflective surface from the bulbs 50 and of the shape of the light beam desired. The central portion 41 has a succession of openings 43 for the passage of the tabs 33 and 34 to extend down to the bulbs 50. The reflector 40 is preferably formed of a metal strip one of the faces of which is polished in order to obtain maximum reflection. In order to avoid any contact between the reflector 40 and the tabs 33 and 34, insulating plugs 44, only one of which is shown in FIG. 1, are advantageously arranged in the passages 43. The shape of the intermediate wall 28 substantially follows that of the reflector 40.

The bulbs 50 may be light tubes or xenon lamps, the ends of each of which are adapted to cooperate with the contact tabs 33 and 34 of the two conductors 30.

In order to conceal the bulbs 50, a diffusion screen 60 is provided at the bottom of the housing 20. The diffusion screen 60 is formed of a strip 61 having edges 62 adapted to fit in one of the pairs of longitudinal grooves 25 in the housing 20 (FIG. 2) below the flanges 42. The strip 61 also has fins 64 which are bent at a 90° angle with respect to the strip 61. The screen 60 is produced, for instance, in a strip 61 of aluminum having one face which is blackened while the other face is reflective. The strip 61 is cut out to form the fins 64 by stamping. The blackened face is arranged toward the outside of the wall in order to avoid any reflection toward the outside.

A protective glass plate 70 may be arranged in an outer pair of longitudinal grooves 25 of the housing 20.

The electrical connection assembly 80 is formed of a feed wire 81 connected at one end to a female connector 82 that cooperates with one of the feed tabs 33 or 34, and on the other end to a male feed connector 83.

The shoe or end piece 90 of the housing 20 is formed by a flat surface 91 of an edge profile shape corresponding to that of the housing 20. It will be advantageous to provide for detaching the edge 92 corresponding to the rail 10 along a line 93. In this way, it is possible to arrange several illuminating striplights of the invention along a single rail. Each end piece 90 has facing toward its outside two feet 94 which are intended to engage on opposite sides of the central portion 21 of the housing 20. The end piece 90 is preferably molded of plastic.

Figure 2:
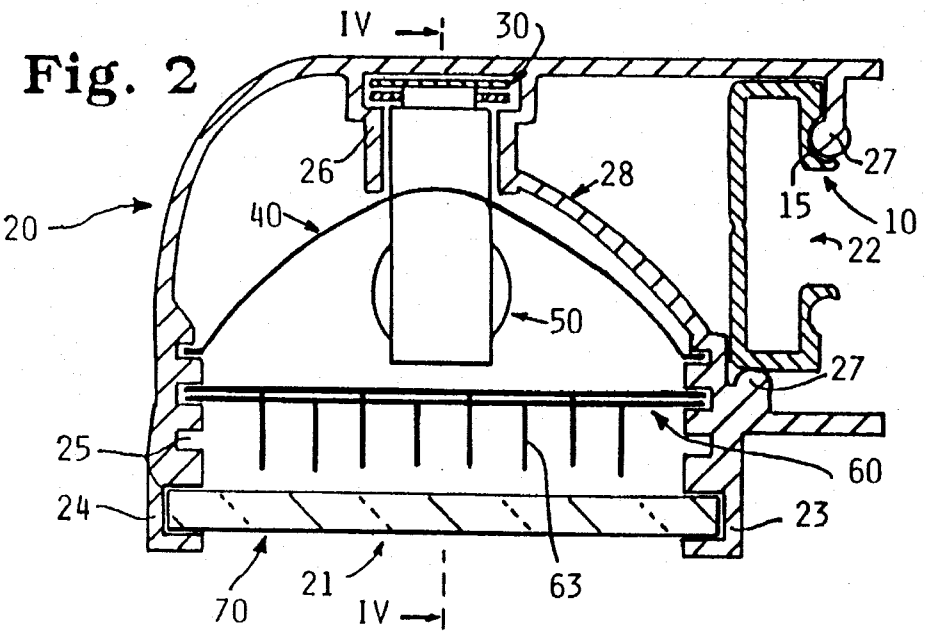
FIG. 2 is a cross section through an assembled light, showing a system for attachment to a structure.

FIG. 2 shows a striplight of the invention in an assembled condition, including the attachment rail 10 for attaching to the profiled member of the housing 20, the conductive strips 30, the reflector 40, a tubular bulb 50, a diffusion screen 60 and the protective glass plate 70 of the assembly. The beads 27 cooperate with the rounded groove 15 and the clearance 14 of the attachment rail 10. Thus, once the rail 10 is attached in an optimal position to the wall to be illuminated, the housing 20 can easily be placed and positioned on the rail 10. The housing 20 engages the rail 10 due to the rounded shapes of the beads 27. Similarly, the housing 20 can be easily removed from the rail 10, for instance, in order to replace the bulbs 50.

FIG. 2 shows the completed assembly of the conductive strips 30 and the reflector 40. The reflector 40 is slid into a pair of longitudinal grooves 25, as are the screens 60 and the protective glass plate 70.

FIG. 2 also shows two superposed screens 60 that have been provided in order to increase the number of fins 63 while leaving a sufficient height for them so that the bulbs 50 are not visible at a certain distance from the wall to which the striplight is attached.

Figure 3:
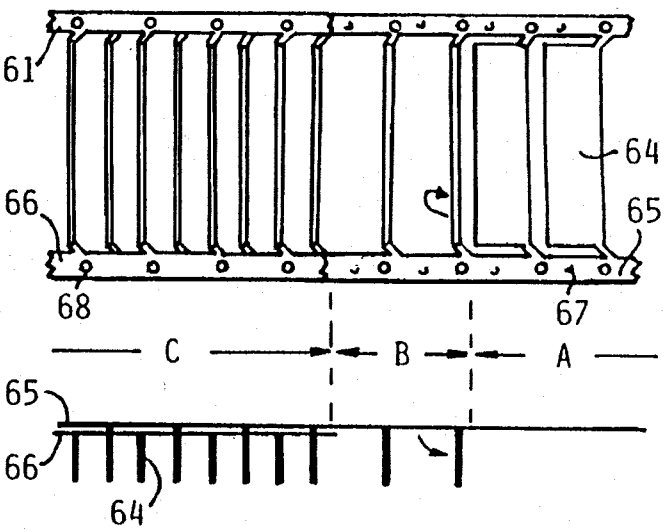
FIG. 3 is a top view and a longitudinal section of various embodiments of a diffusion screen.

FIG. 3 shows three different embodiments of the diffusion screen:

A in which a region of the strip 61 has been cut out to create rectangular shapes 64 that are transverse to the strip 61, while retaining the edges 62;

B in which a region of the strip 61 has rectangular fins 64 that are bent at an angle of 90°; and C in which two screens 65 and 66 are superposed in order to better conceal the sources of light.

To assure the positioning of the screens 65 and 66, equidistant protuberances 67 are provided along the edges 62 for engaging corresponding holes 68 in the other strip.

As shown in FIGS. 2 and 3, the screens 60 used in the striplight of the invention are preferably of two types depending on whether the striplight assembly is arranged horizontally or vertically in order to illuminate a wall. For a horizontal striplight, preferably screens with longitudinal fins 63 may be used, while, for a vertical striplight, preferably screens with transverse fins 64 may be employed.

Figure 4:
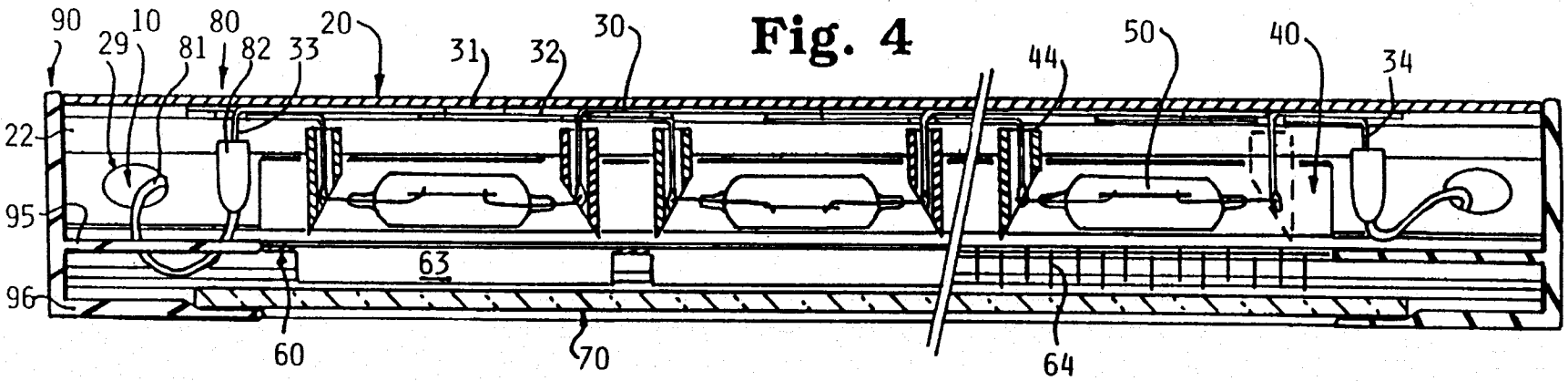
FIG. 4 is a longitudinal cross-sectional view along the line IV—IV of the light assembly of FIG. 2.

FIG. 4 shows two variants; on the left a screen with longitudinal fins 63 is shown and on the right a double screen with transverse fins 64 is shown. FIG. 4 also shows an assembled striplight of the invention. Assembly of the components of the wall striplight of the invention is now described.

The conductive strips 31 and 32 are superposed with tab 33 passing through the opening 35, and the tabs 33 and 34 of both strips 31, 32 being introduced into the passages 43 that are provided in the reflector 40. The assembly thus obtained is slid into the housing 20 through one open end. More precisely, the conductive strips 31, 32 are introduced into the central rail 26, while the reflector 40 is slid into one of the pairs of opposed longitudinal grooves 25 of the housing 20. An insulating plug 44 is then inserted around each tab 33, 34 in the passages 43 before fastening the bulbs 50 to and between two conductor tabs 33, 34. The insulating plugs 44 are cut with a bevel and their longer portion is located beyond the bulbs 50 in order to protect them. The bulbs 50 shown in FIG. 4 are preferably xenon lamps having contacts shaped in the form of loops maintained in forks provided at the ends of the contact tabs. In a known manner, these forks can be developed in intermediate contact pieces, not shown in the drawing.

Electric feed takes place at the two ends of the striplight, since the length of the conductive strips is such that, on each side of the pairs of tabs receiving the bulbs, there remains a tab 33 and 34 respectively which permit the feeding of the conductive strip by the conductor assembly 80. The female connector 82 is placed on one of the tabs 33, 34, while the male connector 83 is connected to a feed plug, at the rear of the intermediate wall 28 between the housing 20 and the rail 10, as shown in FIG. 2.

Depending on the use contemplated, one or two screens 60 may be slid into another pair of grooves 25. The screens 60 may have longitudinal fins 63 or transverse fins 64, as shown on the left and right of FIG. 4. The assembly may be closed by the glass plate 70. The lengths of the screens 60 and of the glass plate 70 are less than the length of the striplight. Each end piece 90 has a protruding portion 95 intended to rest on the end of the screen 60, as well as a tapered return plate 96 adapted to hold the glass plate 70. In order to completely close the assembly which is thus obtained, the return plate 96 fits between the flanges 23 and 24 of the profiled member of the housing 20.

In an embodiment which has not been shown in the drawing, a profiled member having openings 21 and 22 on its opposite faces can also be provided. Thus, for instance, a room having a suspended ceiling could be illuminated by enclosing the striplights between the panels forming the ceiling. Furthermore, a striplight attachment rail could be provided which includes the support means for suspended panels between which striplights in accordance with the invention could be engaged.

As a variant, the striplight of the invention can also be used for illuminating suspended vertical panels, for instance, carpets, curtains, or tapestries. In this case, the profiled member may preferably be modified so that it also permits the fastening of such panels.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A light assembly comprising:

a housing in the form of an elongate profiled member, the housing including a first opening in the housing for the passage of the light beam, and a second opening including a fastener for engaging an attachment rail for attaching the light assembly to a structure;

at least two conductive strips disposed in and extending along the housing, a plurality of tabs provided on each conductive strip and the tabs on the two strips being located a predetermined distance apart so that a respective one of the tabs from both strips cooperate to form electric contacts for holding a bulb between the contacts;

a reflector in the housing of parabolic section and being so shaped and arranged in the housing that the bulb is held located in the vicinity of a focus of the reflector for distributing a narrow beam of light from the bulb along the light assembly;

at least one diffusion screen arranged in the path of the light beam from the reflector and adapted to direct and deflect the light beam in a selected direction.

2. A light assembly according to claim 1, wherein the reflector extends within the housing along a longitudinal direction thereof such that the beam of light is distributed along substantially all of the length of the light assembly.

3. A light assembly according to claim 2, wherein the housing is provided with means for attaching the light assembly to a structure.

4. A light assembly according to claim 2, wherein the reflector is traversed by the tabs forming the electric contacts.

5. A light assembly according to claim 1, wherein the diffusion screen has at least one face in or out of the reflector which is a reflecting face.

6. A light assembly according to claim 1, wherein the diffusion screen has at least one face in or out of the reflector which is a non-reflecting face.

7. A light assembly according to claim 1, wherein the diffusion screen includes fins that are generally parallel to the longitudinal direction of the light assembly.

8. A light assembly according to claim 7, wherein the fins are cut out and folded portions of the screen arranged along a lengthwise direction of the housing.

9. A light assembly according to claim 1, wherein the diffusion screen comprises fins that are generally perpendicular to the longitudinal direction of the light assembly.

10. A light assembly according to claim 9, wherein the fins are cut out and folded portions of the screen arranged along a lengthwise direction of the housing.

11. A light assembly according to claim 9, wherein the diffusion screen includes two superposed screens having respective edges that include positioning means for placing the fins at uniform distances apart.

12. A light assembly according to claim 1, wherein the first opening is bordered by two lateral flanges, each flange being provided with a plurality of facing longitudinal grooves adapted to receive the reflector.

13. Several light assemblies according to claim 1 for illuminating large surfaces, wherein the light assemblies are striplights that are arranged end to end in such a manner that the beam of light is substantially parallel to the surface in order to illuminate it uniformly.

14. The use of several light assemblies according to claim 13, wherein each light assembly includes at least one screen, the screens are arranged in such a manner so as to conceal the respective bulbs from view.

15. A light assembly comprising:

a housing in the form of an elongate profiled member;

at least two conductive strips in and extending along the housing, a plurality of tabs provided on each conductive strip and the tabs on the two strips being located a predetermined distance apart so that a respective one of the tabs from both strips cooperate to form a pair of electric contacts for holding a bulb between the pair of contacts;

a reflector in the housing of generally parabolic section and being so shaped and arranged in the housing that the bulb is held located in the vicinity of a focus of the reflector for distributing a narrow beam of light from the bulb along the light assembly;

at least one diffusion screen arranged in the path of the light beam from the reflector and adapted to direct and deflect the light beam in a selected direction;

a first opening in the housing for the passage of the light beam, the first opening being bordered by two lateral flanges, each flange provided with a plurality of facing longitudinal grooves adapted to receive the reflector and the diffusion screen;

a protective glass plate for being retained by a corresponding pair of facing longitudinal grooves.

16. A light assembly according to claim 15, wherein the housing further comprises a second opening; means for attaching the light assembly to a structure, the means for attaching the light assembly to a structure including fastening means located at the second opening of the housing; an attachment rail, the fastening means being adapted to cooperate with the attachment rail for attaching the light assembly to a structure.

17. A light assembly according to claim 16, wherein the fastening means includes beads adapted to cooperate with corresponding groove means provided in the rail.

18. A light assembly comprising:

a housing in the form of an elongate profiled member;

at least two conductive strips in and extending along the housing, a plurality of tabs provided on each conductive strip and the tabs on the two strips being located a predetermined distance apart so that a respective one of the tabs from both strips cooperate to form a pair of electric contacts, and a bulb between the pair of contacts;

a reflector in the housing of generally parabolic section and being so shaped and arranged in the housing that the bulb is located in the vicinity of a focus of the reflector for distributing a narrow beam of light from the bulb along the light assembly;

a first opening in the housing for the passage of the light beam, the first opening being bordered by two lateral flanges, each flange provided with a plurality of facing longitudinal grooves adapted to receive the reflector;

a second opening in the housing; means for attaching the light assembly to a structure, the means for attaching the light assembly to a structure including fastening means located at the second opening of the housing; an attachment rail, the fastening means being adapted to cooperate with the attachment rail for attaching the light assembly to a structure.

* * * * *